US009598202B2

(12) United States Patent
Oliveira et al.

(10) Patent No.: US 9,598,202 B2
(45) Date of Patent: Mar. 21, 2017

(54) CARTON WITH HANDLE

(71) Applicant: GRAPHIC PACKAGING INTERNATIONAL, INC., Atlanta, GA (US)

(72) Inventors: Steven M. Oliveira, Canton, GA (US); Kelly R. Fitzwater, Lakewood, CO (US)

(73) Assignee: Graphic Packaging International, Inc., Atlanta, GA (US)

( * ) Notice: Subject to any disclaimer, the term of this patent is extended or adjusted under 35 U.S.C. 154(b) by 24 days.

(21) Appl. No.: 14/337,626

(22) Filed: Jul. 22, 2014

(65) Prior Publication Data

US 2015/0028087 A1 Jan. 29, 2015

Related U.S. Application Data

(60) Provisional application No. 61/958,266, filed on Jul. 24, 2013.

(51) Int. Cl.

| | |
|---|---|
| ***B65D 5/46*** | (2006.01) |
| ***B65D 71/30*** | (2006.01) |
| ***B65D 5/02*** | (2006.01) |

(52) U.S. Cl.

CPC ..... *B65D 5/46192* (2013.01); *B65D 5/0227* (2013.01)

(58) Field of Classification Search

CPC ... B65D 5/46192; B65D 5/0227; B65D 71/30
USPC ..... 229/117.13, 117.14
See application file for complete search history.

(56) References Cited

U.S. PATENT DOCUMENTS

| | | | |
|---|---|---|---|
| 1,253,193 | A | 1/1918 | Hill |
| 2,372,351 | A | 3/1945 | Arneson |
| 2,383,183 | A | 8/1945 | Fishcher |
| 2,482,399 | A | 9/1949 | Bullock |

(Continued)

FOREIGN PATENT DOCUMENTS

| | | |
|---|---|---|
| CA | 740309 | 8/1966 |
| CA | 877792 | 8/1971 |

(Continued)

OTHER PUBLICATIONS

International Search Report and Written Opinion for PCT/US2014/047563 dated Nov. 28, 2014.

*Primary Examiner* — Gary Elkins
(74) *Attorney, Agent, or Firm* — Womble Carlyle Sandridge & Rice, LLP

(57) ABSTRACT

A carton for containing a flowable material. The carton comprises a plurality of panels that extends at least partially around an interior of the carton. The plurality of panels comprises at least a top panel. At least two end flaps are respectively foldably attached to respective panels of the plurality of panels. The at least two end flaps comprise a top end flap foldably connected to the to panel. An integrated handle comprises a handle panel extending in the top panel and into the top end flap and a handle closure at least partially in face-to-face contact with at least the top panel. The handle panel overlaps at least a portion of the handle closure, and the handle closure at least partially forms a barrier in the top panel adjacent the handle panel for at least partially preventing flowable material from exiting the carton at the integrated handle.

47 Claims, 10 Drawing Sheets

(56) References Cited

U.S. PATENT DOCUMENTS 2,594,376 A 4/1952 Arneson
2,681,143 A 6/1954 Guyer
2,702,144 A 2/1955 Forrer
2,797,856 A 7/1957 Jaeschke
2,810,506 A 10/1957 Kessler
2,819,506 A 10/1957 Kessler
2,842,304 A 7/1958 Ringler
2,851,210 A 9/1958 Kramer et al.
2,868,433 A * 1/1959 Anderson, Jr. .... B65D 5/46192 229/117.13
2,896,838 A 7/1959 Struble
2,955,739 A 10/1960 Collura
2,986,324 A * 5/1961 Anderson, Jr. .... B65D 5/46192 229/117.13
3,076,591 A 2/1963 Nute et al.
3,094,268 A 6/1963 Swanson et al.
3,112,856 A 12/1963 MacIntosh et al.
3,127,720 A 4/1964 Gentry et al.
3,204,815 A 9/1965 Weis
3,300,119 A 1/1967 Chaussadas
3,309,005 A 3/1967 Pilger
3,334,767 A 8/1967 Cornelius et al.
3,355,012 A 11/1967 Weiss
3,367,557 A 2/1968 Farguhar
3,371,846 A 3/1968 Detzel
3,381,881 A 5/1968 Granz et al.
3,794,239 A * 2/1974 Bonczyk ..... B65D 5/46192 229/117.13
3,797,729 A 3/1974 Holmes
3,827,550 A 8/1974 Arneson
3,828,926 A 8/1974 Rossi
3,886,901 A 6/1975 Zeitter
3,894,681 A 7/1975 Arneson et al.
3,904,036 A 9/1975 Forrer
3,933,303 A 1/1976 Kirby, Jr.
3,955,748 A 5/1976 Calvert
3,994,432 A 11/1976 Kirby, Jr.
4,029,204 A 6/1977 Manizza
4,032,218 A 6/1977 Scheffer
4,036,423 A 7/1977 Gordon
4,093,116 A 6/1978 Watkins et al.
4,096,985 A 6/1978 Wood
4,111,306 A 9/1978 Roccaforte
4,215,781 A 8/1980 Humphries et al.
4,216,861 A 8/1980 Oliff
4,318,474 A 3/1982 Hasegawa
4,327,829 A 5/1982 Hughes
4,328,923 A 5/1982 Graser
4,329,923 A 5/1982 Iida
4,331,289 A 5/1982 Killy
4,364,509 A 12/1982 Holley et al.
4,375,258 A 3/1983 Crayne et al.
4,378,905 A 4/1983 Roccaforte
4,382,505 A 5/1983 Sutherland et al.
4,396,143 A 8/1983 Killy
4,405,078 A 9/1983 Dutcher et al.
4,418,864 A 12/1983 Nielsen
4,424,901 A 1/1984 Lanier
4,440,340 A 4/1984 Bakx
4,447,004 A 5/1984 House et al.
4,470,503 A 9/1984 Stone
4,478,334 A 10/1984 Graser
4,482,090 A 11/1984 Milliens
4,498,581 A 2/1985 Dutcher
4,498,619 A 2/1985 Roccaforte
4,508,258 A 4/1985 Graser
4,538,759 A 9/1985 Dutcher
4,545,485 A 10/1985 Oliff
4,546,914 A 10/1985 Roccaforte
4,577,799 A 3/1986 Oliff
4,588,084 A 5/1986 Holley, Jr.
4,653,686 A 3/1987 Wood et al.
4,706,876 A 11/1987 Wilson
4,712,728 A 12/1987 Schuster
4,747,487 A 5/1988 Wood
4,747,534 A 5/1988 Marie
4,784,266 A 11/1988 Chaussadas
4,784,316 A 11/1988 Crouch
4,802,583 A 2/1989 Calvert et al.
4,830,267 A 5/1989 Wilson
4,838,479 A 6/1989 Wood
4,875,586 A 10/1989 Chaussadas
4,966,324 A 10/1990 Steel
4,989,778 A 2/1991 Saulas
5,020,337 A 6/1991 Krieg
5,060,792 A 10/1991 Oliff
5,072,876 A 12/1991 Wilson
5,094,359 A 3/1992 DeMars et al.
5,106,014 A 4/1992 Miller
5,119,985 A 6/1992 Dawson et al.
5,197,598 A 3/1993 Stout et al.
5,221,041 A 6/1993 Stout et al.
5,222,658 A 6/1993 DeMaio et al.
5,234,102 A 8/1993 Schuster et al.
5,246,112 A 9/1993 Stout et al.
5,284,294 A 2/1994 Floyd
5,292,058 A 3/1994 Zoss et al.
5,297,725 A 3/1994 Sutherland
5,303,863 A 4/1994 Arasim
5,307,932 A 5/1994 Stout et al.
5,307,986 A 5/1994 Schuster
5,307,987 A * 5/1994 Roccaforte ..... B65D 5/46192 229/117.13
5,320,277 A 6/1994 Stout et al.
5,328,081 A 7/1994 Saulas
5,333,734 A 8/1994 Stout et al.
D350,480 S 9/1994 Sutherland
5,379,944 A 1/1995 Stout et al.
5,381,891 A 1/1995 Harris
5,385,234 A 1/1995 Stout et al.
5,395,044 A 3/1995 Stout
5,427,241 A 6/1995 Sutherland
5,427,307 A 6/1995 Campbell
5,458,234 A 10/1995 Harris
5,472,090 A 12/1995 Sutherland
5,480,091 A 1/1996 Stout
5,482,203 A 1/1996 Stout
5,485,915 A 1/1996 Harris
5,495,727 A 3/1996 Strong et al.
5,524,756 A 6/1996 Sutherland
5,551,556 A 9/1996 Sutherland
5,582,343 A 12/1996 Dalvey
5,593,027 A 1/1997 Sutherland
5,639,017 A 6/1997 Fogle
5,647,483 A 7/1997 Harris
5,669,500 A 9/1997 Sutherland
5,699,957 A 12/1997 Bin et al.
5,704,470 A 1/1998 Sutherland
5,738,273 A 4/1998 Auclair
5,739,273 A 4/1998 Engelman et al.
5,794,778 A 8/1998 Harris
5,826,782 A 10/1998 Stout
5,873,515 A 2/1999 Dunn et al.
5,878,946 A 3/1999 Frerot et al.
5,906,313 A 5/1999 Oliff
5,915,546 A 6/1999 Harrelson
5,992,733 A 11/1999 Gomes
5,996,883 A 12/1999 Bates
6,019,276 A 2/2000 Auclair
6,021,897 A 2/2000 Sutherland
6,065,590 A 5/2000 Spivey
6,085,969 A 7/2000 Burgoyne
6,105,853 A 8/2000 Lamare
6,105,854 A 8/2000 Spivey et al.
6,112,977 A 9/2000 Sutherland et al.
6,129,266 A 10/2000 Oliff et al.
6,131,803 A 10/2000 Oliff et al.
6,164,526 A 12/2000 Dalvey
6,170,741 B1 1/2001 Skolik et al.
6,227,367 B1 5/2001 Harrelson et al.
6,260,755 B1 7/2001 Bates et al.
6,302,320 B1 10/2001 Stout
D452,154 S 12/2001 Rhodes et al.
6,371,365 B1 4/2002 Doucette et al.

(56) References Cited

U.S. PATENT DOCUMENTS

| | | | |
|---|---|---|---|
| 6,425,520 | B1 | 7/2002 | Peterson |
| 6,523,739 | B2 | 2/2003 | Heeley et al. |
| 6,536,656 | B2 | 3/2003 | Auclair et al. |
| 6,631,803 | B2 | 10/2003 | Rhodes et al. |
| 6,758,337 | B2 | 7/2004 | Chargueraud et al. |
| 6,766,940 | B2 | 7/2004 | Negelen |
| 6,834,793 | B2 | 12/2004 | Sutherland |
| 6,848,573 | B2 | 2/2005 | Gould et al. |
| 6,869,009 | B2 | 3/2005 | Sutherland et al. |
| 6,899,221 | B2 | 5/2005 | Skolik et al. |
| 6,905,066 | B2 | 6/2005 | Holley et al. |
| 6,926,193 | B2 | 8/2005 | Smalley |
| 6,945,450 | B2 | 9/2005 | Rusnock |
| 6,968,992 | B2 | 11/2005 | Schuster |
| 7,007,836 | B2 | 3/2006 | Smalley |
| 7,234,596 | B2 | 6/2007 | Lebras |
| 7,296,731 | B2 | 11/2007 | Auclair et al. |
| 7,380,701 | B2 | 6/2008 | Fogle et al. |
| 7,416,109 | B2 | 8/2008 | Sutherland |
| 7,427,010 | B2 | 9/2008 | Sutherland |
| 7,472,791 | B2 | 1/2009 | Spivey, Sr. |
| 7,601,111 | B2 | 10/2009 | Sutherland et al. |
| 7,699,215 | B2 | 4/2010 | Spivey, Sr. |
| 7,743,944 | B2 | 6/2010 | Ho Fung et al. |
| 7,743,968 | B2 | 6/2010 | Theelen |
| 7,748,603 | B2 | 7/2010 | Fogle et al. |
| 7,757,933 | B2 | 7/2010 | Dunn |
| 7,793,779 | B2 | 9/2010 | Spivey, Sr. et al. |
| 7,806,314 | B2 | 10/2010 | Sutherland |
| 8,070,052 | B2 | 12/2011 | Spivey, Sr. et al. |
| 8,459,533 | B2 | 6/2013 | Requena et al. |
| 8,740,051 | B2 | 6/2014 | Gonzalez |
| 8,840,009 | B2 | 9/2014 | Spivey, Sr. et al. |
| 2001/0017314 | A1 | 8/2001 | Boukredine et al. |
| 2002/0088820 | A1 | 7/2002 | Spivey |
| 2003/0015579 | A1 | 1/2003 | LeBras et al. |
| 2003/0136820 | A1 | 7/2003 | Negelen |
| 2003/0213263 | A1 | 11/2003 | Woog |
| 2004/0050917 | A1 | 3/2004 | Smalley |
| 2004/0074954 | A1 | 4/2004 | Fogle et al. |
| 2005/0056658 | A1 | 3/2005 | Spivey |
| 2005/0087592 | A1 | 4/2005 | Schuster |
| 2005/0167478 | A1 | 8/2005 | Holley, Jr. |
| 2005/0247767 | A1 | 11/2005 | Smalley |
| 2006/0071058 | A1 | 4/2006 | Spivey, Sr. |
| 2006/0169755 | A1 | 8/2006 | Spivey, Sr. |
| 2006/0273143 | A1 | 12/2006 | Finch |
| 2007/0039846 | A1 | 2/2007 | Spivey, Sr. |
| 2007/0051781 | A1 | 3/2007 | Holley, Jr. |
| 2007/0108261 | A1 | 5/2007 | Schuster |
| 2007/0164091 | A1 | 7/2007 | Fogle et al. |
| 2007/0181658 | A1 | 8/2007 | Sutherland |
| 2007/0205255 | A1 | 9/2007 | Dunn |
| 2007/0284424 | A1 | 12/2007 | Holley |
| 2007/0295789 | A1 | 12/2007 | Ho Fung |
| 2008/0048014 | A1 | 2/2008 | Bates |
| 2008/0073420 | A1 | 3/2008 | Walling et al. |
| 2008/0083820 | A1 | 4/2008 | Walling et al. |
| 2008/0099544 | A1 | 5/2008 | Skolik |
| 2008/0119344 | A1 | 5/2008 | Sutherland et al. |
| 2009/0236408 | A1 | 9/2009 | Spivey, Sr. |
| 2009/0255983 | A1 | 10/2009 | De Paula et al. |
| 2010/0127057 | A1 | 5/2010 | Burke |
| 2010/0213249 | A1 | 8/2010 | Requena et al. |
| 2012/0091190 | A1* | 4/2012 | Smalley ..... B65D 71/20 229/117.13 |
| 2012/0104079 | A1 | 5/2012 | Wagner |
| 2012/0321754 | A1 | 12/2012 | Block |

FOREIGN PATENT DOCUMENTS

| | | |
|---|---|---|
| CA | 1 243 987 | 11/1988 |
| CA | 2 160 145 | 9/1995 |
| CH | 601064 | 6/1978 |
| DE | 85 14 718.4 | 6/1985 |
| DE | 296 07 374 | 4/1996 |
| DE | 296 13 814 | 10/1996 |
| DE | 201 12 228 | 11/2002 |
| DE | 2004 018 649 | 4/2005 |
| EP | 0 003 935 | 9/1979 |
| EP | 0 341 089 | 11/1989 |
| EP | 0 412 226 | 2/1991 |
| EP | 0 473 266 | 3/1992 |
| EP | 0 754 631 | 1/1997 |
| EP | 1 612 157 | 1/2006 |
| FR | 1 489 093 | 6/1967 |
| FR | 1 494 239 | 9/1967 |
| FR | 2 274 059 | 1/1976 |
| FR | 2 481 231 | 10/1981 |
| FR | 2 579 175 | 9/1986 |
| GB | 2 206 565 | 1/1989 |
| GB | 2 252 958 | 8/1992 |
| JP | 8-503187 | 4/1996 |
| JP | 2005-507831 | 3/2005 |
| KR | 20-0356729 | 7/2004 |
| WO | WO 94/10047 | 5/1994 |
| WO | WO 95/05324 | 2/1995 |
| WO | WO 96/01770 | 1/1996 |
| WO | WO 96/20881 | 7/1996 |
| WO | WO 96/21603 | 7/1996 |
| WO | WO 96/21604 | 7/1996 |
| WO | WO 96/27538 | 9/1996 |
| WO | WO 97/44253 | 11/1997 |
| WO | WO 98/19932 | 5/1998 |
| WO | WO 99/28207 | 6/1999 |
| WO | WO 00/20288 | 4/2000 |
| WO | WO 00/78618 | 12/2000 |
| WO | WO 01/66434 | 9/2001 |
| WO | WO 02/36440 | 5/2002 |
| WO | WO 03/037742 | 5/2003 |
| WO | WO 2005/080218 | 9/2005 |
| WO | WO 2005/123532 | 12/2005 |
| WO | WO 2006/084009 | 8/2006 |
| WO | WO 2007/089282 | 8/2007 |
| WO | WO 2009/117562 | 9/2009 |
| WO | WO 2012/061682 A2 | 5/2012 |

* cited by examiner

CARTON WITH HANDLE

CROSS-REFERENCE TO RELATED APPLICATIONS

This application claims the benefit of U.S. Provisional Patent Application No. 61/958,266, filed Jul. 24, 2013.

INCORPORATION BY REFERENCE

The disclosure of U.S. Provisional Patent Application No. 61/958,266, which was filed on Jul. 24, 2013, is hereby incorporated by reference for all purposes as if presented herein in its entirety.

BACKGROUND OF THE DISCLOSURE

The present disclosure generally relates to cartons for holding and carrying contents such as powders, granular materials, other flowable materials, and/or other products. More specifically, the present disclosure relates to cartons having a handle.

SUMMARY OF THE DISCLOSURE

In general, one aspect of the disclosure is directed to a carton for containing a flowable material. The carton comprises a plurality of panels that extends at least partially around an interior of the carton. The plurality of panels comprises at least a top panel. At least two end flaps are respectively foldably attached to respective panels of the plurality of panels. The at least two end flaps at least partially form an at least partially closed end of the carton, and the at least two end flaps comprise a top end flap foldably connected to the top panel. An integrated handle comprises a handle panel extending in the top panel and into the top end flap and a handle closure at least partially in face-to-face contact with at least the top panel. The handle panel overlaps at least a portion of the handle closure, and the handle closure at least partially forms a barrier in the top panel adjacent the handle panel for at least partially preventing flowable material from exiting the carton at the integrated handle when the handle panel is in a flat position or in an actuated position.

In another aspect, the disclosure is generally directed to a blank for forming a carton for containing a flowable material. The blank comprises a plurality of panels comprising at least a top panel, and at least two end flaps respectively foldably attached to respective panels of the plurality of panels. The at least two end flaps are fix at least partially forming, an at least partially closed end of the carton formed from the blank. The at least two end flaps comprise a top end flap foldably connected to the top panel. The blank further comprises handle features or forming an integrated handle comprising a handle panel extending in the top panel and into the top end flap and a handle closure for being disposed at least partially in face-to-face contact with at least the top panel when the carton is formed from the blank. The handle panel is for overlapping at least a portion of the handle closure when the carton is formed from the blank, and the handle closure is for at least partially forming a barrier in the top panel adjacent the handle panel when the carton is formed from the blank for at least partially preventing flowable material from exiting the carton firmed from the blank at the integrated handle.

In another aspect, the disclosure is generally directed to a method of assembling a carton for containing a flowable material. The method comprises obtaining a blank comprising a plurality of panels comprising at least a top panel, and at least two end flaps respectively foldably attached to respective panels of the plurality of panels. The at least two end flaps comprise a top end flap foldably connected to the top panel. The blank further comprises handle features comprising a handle panel extending in the top panel and into the top end flap and a handle closure. The method further comprises forming an interior of the carton at least partially defined by the plurality of panels. The forming the interior of the carton comprises forming an integrated handle from the handle features by disposing the handle closure at least partially in face-to-face contact with at least the top panel so that the handle panel overlaps at least a portion of the handle closure. The handle closure at least partially forms a harrier in the top panel adjacent the handle panel for at least partially preventing flowable material from exiting the carton at the integrated handle. The method further comprises forming an at least partially closed end of the carton by at least partially overlapping the at least two end flaps.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons with features for containing and facilitating dispensing articles such as flowable materials liquids, powders, etc. The articles can include, but are not limited to, particulates, granular materials, powders, and the like, or any combination thereof. Examples of such materials include, but are not limited to, rice, beans, sugar, flour and other flowable solid products, such as soaps and detergents. In this specification, the terms "inner," "interior," "outer" "exterior," "lower," "bottom," "upper," and "top" indicate orientations determined in relation to fully erected and upright cartons.

Figure 1:
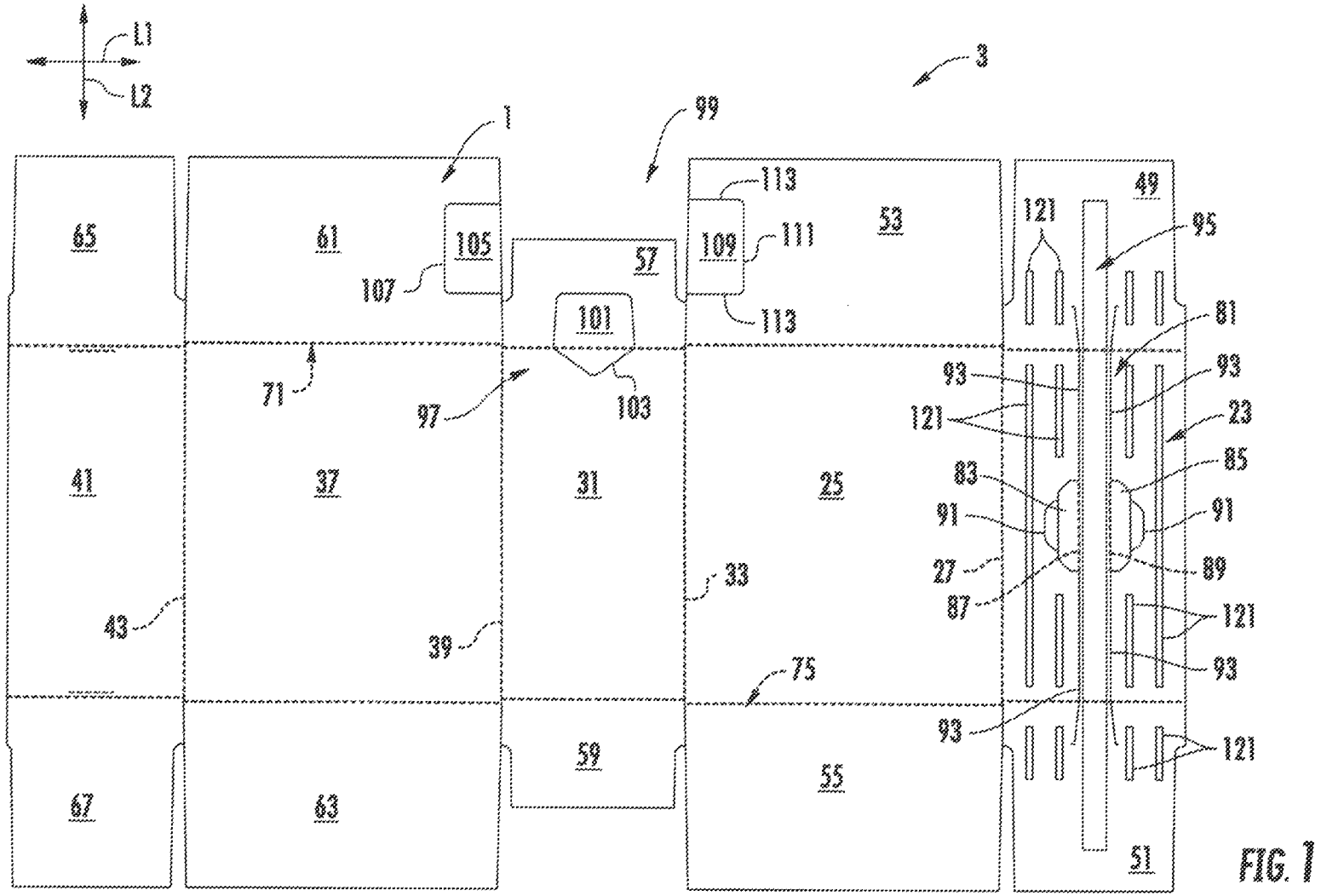
FIG. 1 is an interior plan view of a blank used to form a carton in accordance with a first exemplary embodiment of the disclosure.
Figure 2:
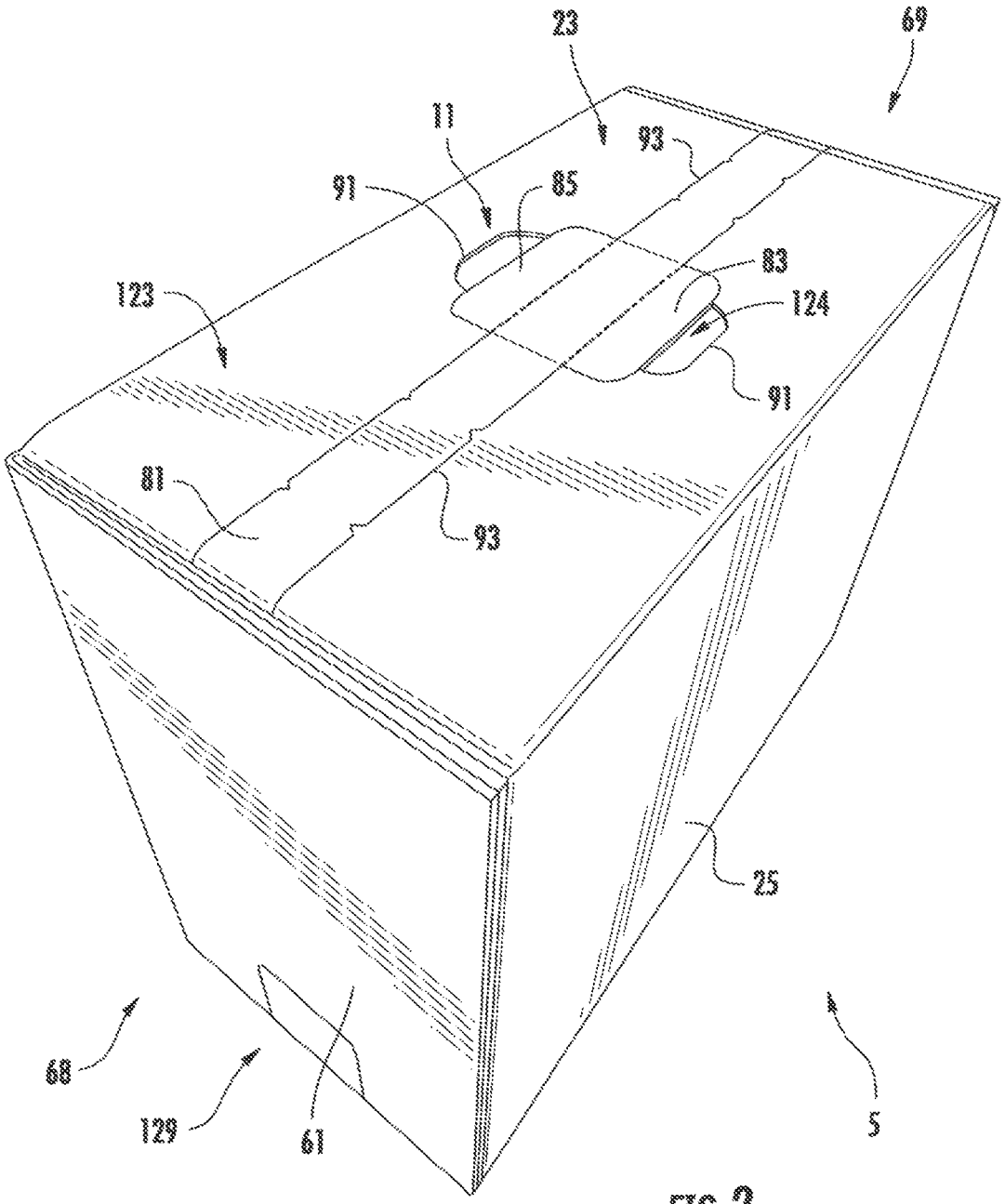
FIG. 2 is a perspective view of the assembled carton in accordance with the first exemplary embodiment of the disclosure.
Figure 3:
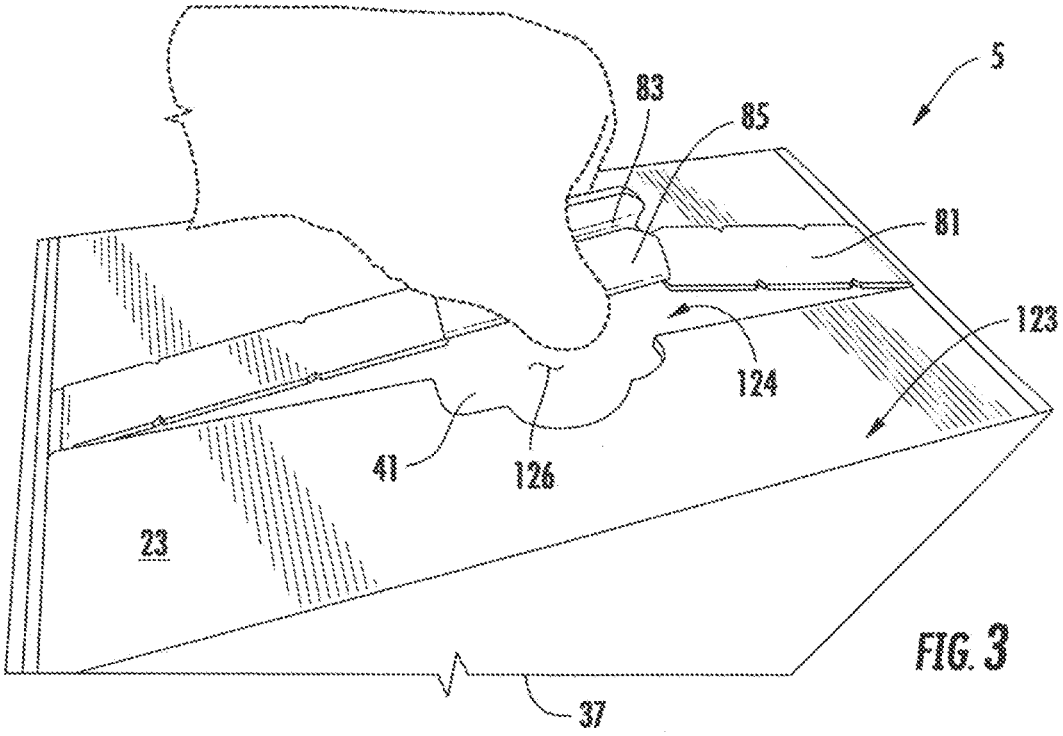
FIGS. 3-5 are perspective views of the carton of FIG. 2 showing the activation of a handle in accordance with the first exemplary embodiment of the disclosure.
Figure 4:
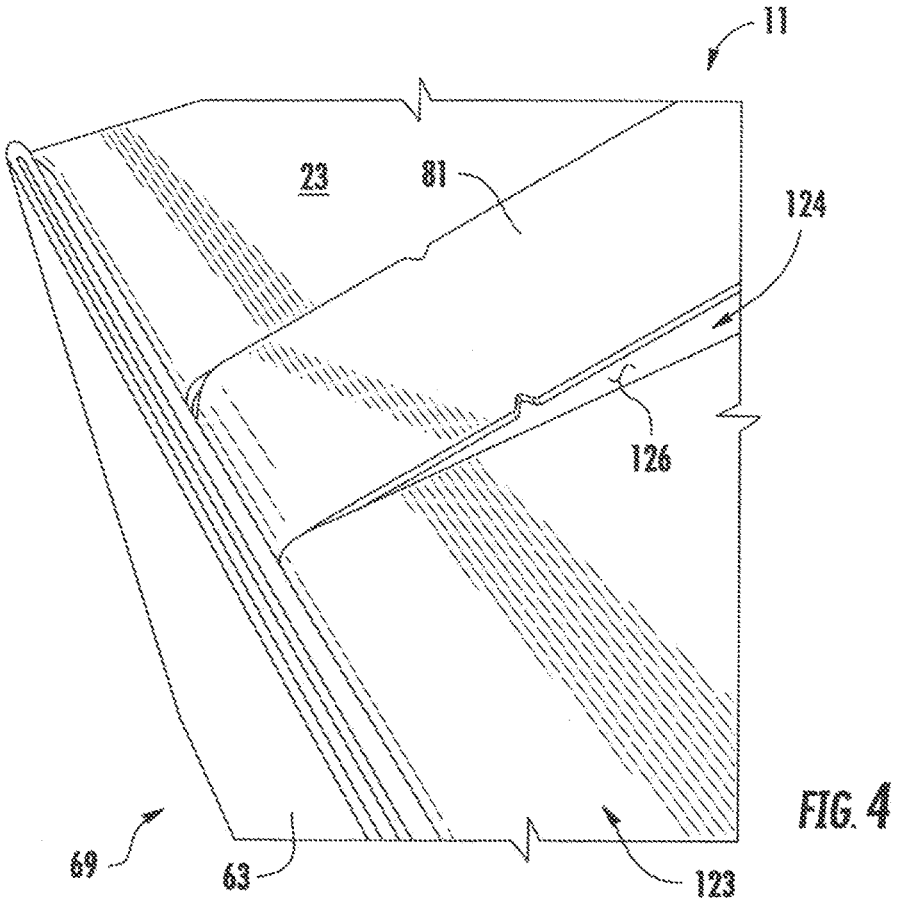
Figure 5:
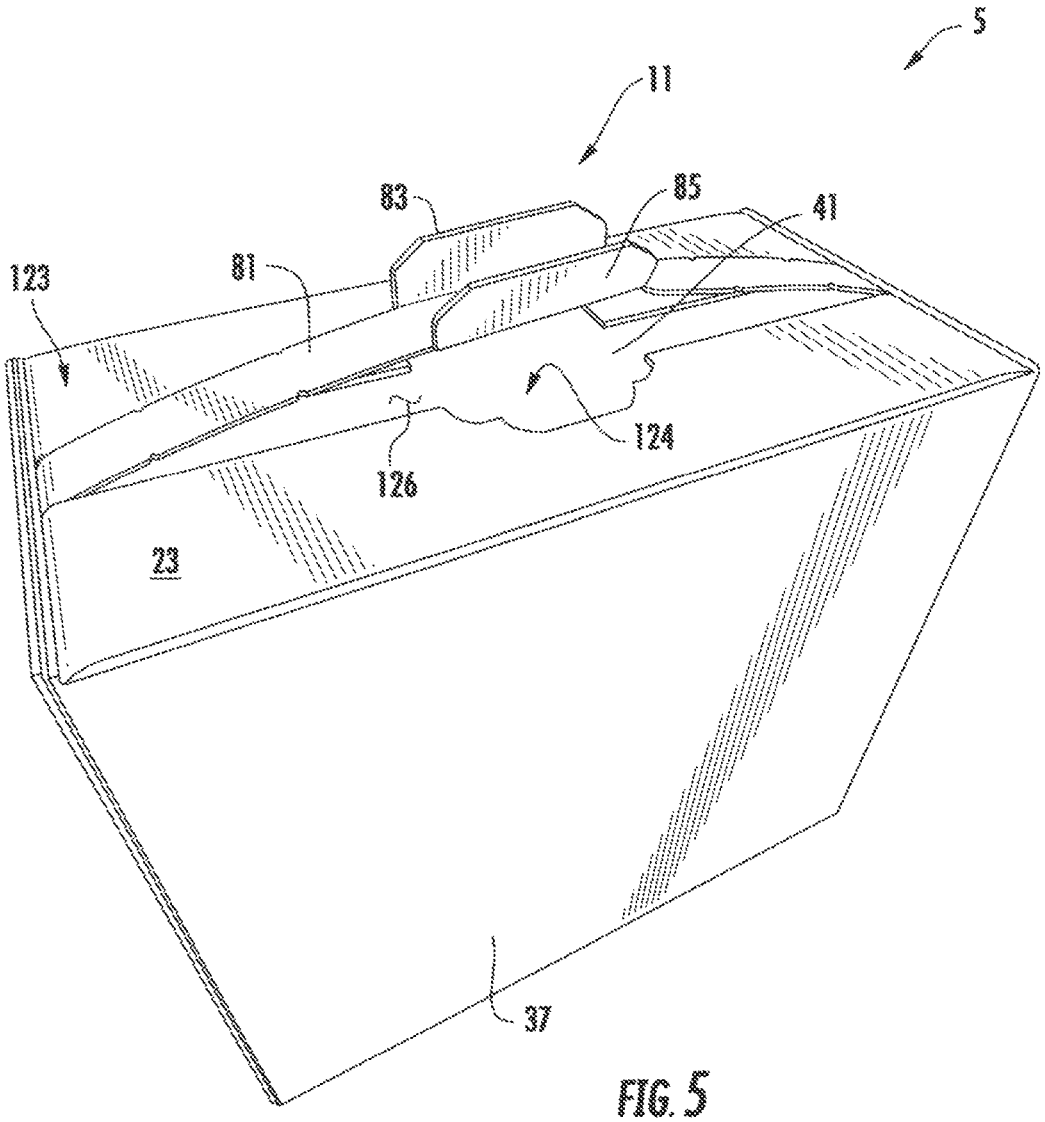

FIG. 1 is a plan view of the interior side 1 of a blank, generally indicated at 3, used to form a carton 5 (FIG. 2) according to the exemplary embodiment of the disclosure. The carton 5 can be used to hold articles (not shown) such as a plurality of food products (e.g., candy, crackers, popcorn, breakfast cereal, or any other food product), nonfood products (grass seed, fertilizer, detergent, litter, or any other nonfood product), or any other suitable article or product within an interior (not shown) of the carton. In the illustrated embodiment, the carton 5 is sized to contain several liters of flowable material, but it is understood that the carton 5 may be sized and shaped to hold contents of a different quantity. In one embodiment, the carton 5 can contain approximately 14 pounds to approximately 40 pounds of product. In the illustrated embodiment, the carton 5 includes a handle, generally indicated at 11, for grasping and carrying the carton (FIGS. 3-5). As will be discussed below in more detail, the handle 11 (e.g., integrated handle) is formed from various features in the blank 3.

The blank 3 has a longitudinal axis L1 extending generally in the direction of the length of the blank and a lateral axis L2 extending generally in the direction of the width of the blank. The blank 3 includes a first or outer top panel 23 foldably connected to a first side panel 25 at a lateral fold line 27. A bottom panel 31 is foldably connected to the first side panel 25 at a lateral fold line 33. A second side panel 37 is foldably connected to bottom panel 31 at a lateral fold line 39. A second or inner top panel 41 is foldably connected to the second side panel 37 at a lateral fold line 43.

The outer top panel 23 is foldably connected to a first outer top end flap 49 and a second outer top end flap 51. The first side panel 25 is foldably connected to a first side end flap 53 and a second side end flap 55. The bottom panel 31 is foldably connected to a first bottom end flap 57 and a second bottom end flap 59. The second side panel 37 is foldably connected to a first side end flap 61 and a second side end flap 63. The inner top panel 41 is foldably connected to a first inner top flap 65 and a second inner top flap 67. When the carton 5 is erected, the end flaps 49, 53, 57, 61, 65 close a first end 68 of the carton, and the end flaps 51, 55, 59, 63, 67 close a second end 69 of the carton (FIG. 2). In accordance with an alternative embodiment of the present disclosure, different panel and flap arrangements can be used for at least partially closing the ends 68, 69 of the carton 5.

The end flaps 49, 53, 57, 61, 65 of the first end 68 extend along a first marginal area of the blank 3, and are foldably connected at a first longitudinal fold line 71 that extends along the length of the blank. The end flaps 51, 55, 59, 63, 67 of the second end 69 extend along a second marginal area of the blank 3, and are foldably connected at a second longitudinal fold line 75 that extends along the length of the blank. The longitudinal fold lines 71, 75 may be, for example, substantially straight, or offset at one or more locations to account for blank thickness or for other factors. The end flaps 49, 51, 53, 55, 57, 59, 61, 63, 65, 67 can be alternatively shaped, arranged, positioned, and/or omitted without departing from the disclosure.

In the illustrated embodiment, the features that form the integrated handle 11 can include a handle panel 81 extending in the outer top panel 23 and into the outer top end flaps 49, 51. As shown in FIG. 1, the handle panel 81 can be foldably connected to two handle flaps 83, 85 along respective handle fold lines 87, 89, and each of the handle flaps 83, 85 can extend adjacent a respective access feature 91. In one embodiment, the access features 91 comprise openings in the outer top panel 23. Alternatively, the access features could include tear out panels or other features. In the exemplary embodiment, the handle panel 81 can be defined by a tear or cut lines 93 extending from each end of the handle fold lines 87, 89. In one embodiment, the cut lines 93 can include one or more nicks in the outer top panel 23 and/or in the top end flaps 49, 51 to help the handle panel 81 stay in place (e.g., generally planar with the outer top panel 23 and the top end flaps 49, 51) until the handle is activated by a user. In the illustrated embodiment, the cut lines 93 generally extend in the lateral direction L2 in the outer top panel 23 and are oblique in the top end flaps 49, 51. In one embodiment, the cut lines 93 can include hook-shaped ends to help prevent unwanted tearing of the to end flaps 49, 51. As shown in FIG. 1, a reinforcing tape 95 can be adhered or otherwise secured to the handle panel 81 on the interior side 1 of the blank 3. Alternatively, or in addition, a reinforcing tape could be applied to the exterior side of the blank 3. The reinforcing tape 95 can extend beyond the ends of the cut lines 93 in the top end flaps 49, 51, as shown in FIG. 1. The handle features could be otherwise shaped, arranged, positioned, and/or configured without departing from the disclosure.

In one embodiment, the carton 5 can include dispenser features 97 for forming a dispenser 129 (FIG. 2) at a dispensing corner 99 for allowing access to the flowable materials or other products in the carton. The dispenser features 97 can include an inner dispenser panel 101 at least partially defined by a cut or tear line 103 extending in the bottom end flap 57 and into the bottom panel 31, an intermediate dispenser panel 105 at least partially defined by a cut or tear line 107 extending in the side end flap 61, and an outer dispenser panel 109 at least partially defined by a dispenser fold line 111 and cut or tear lines 113 extending in the side end flap 53. In one embodiment, the dispenser panels 101, 105, 109 can be overlapped and glued to one another to form the dispenser when the first end 68 of the carton 5 is formed. The dispenser can be opened by tearing along the tear lines 101, 107, 113 and folding the dispenser panels 101, 105, 109 upwardly along the dispenser fold line 111 to form a dispenser opening (not shown). The disperser features 97 could be otherwise shaped, arranged, positioned, and configured without departing from the disclosure.

The dispenser features 97 may be otherwise sized, shaped, and/or located in the blank 3 without departing from the scope of this disclosure. For example, a dispenser panel might extend in any one or more of the panels 23, 25, 31, 37, 41 and/or end flaps 49, 51, 53, 55, 57, 59, 61, 63, 65, 67. Further, the dispenser features 97 may be omitted from the blank 3 without departing from the scope of the disclosure.

In accordance with the exemplary embodiment, the blank 3 can be erected into the carton 5 by folding the blank 3 along fold lines 27, 33, 39, and 43 and overlapping the inner top panel 41 and the outer top panel 23 so that the outer surface of the inner top panel 41 is at least partially in face-to-face contact with the interior surface of the outer top panel 23 to form an open-ended sleeve (not shown). In one embodiment, glue strips 121 (FIG. 1) can be applied to the interior surface of the outer to panel 23 and/or the top end flaps 49, 51 to adhere the outer top panel 23 and/or the top end flaps 49, 51 to the inner top panel 41 and/or the top end flaps 65, 67. The overlapped inner top panel 41 and outer top panel 23 generally can form a top wall 123 (FIGS. 2-4) in the illustrated embodiment.

The first end 68 of the carton 5 can be closed by respectively overlapping and adhering the end flaps 49, 53, 57, 61, 65, and the second end 69 of the carton can be closed by respectively overlapping and adhering the end flaps 51, 55, 59, 63, 67. Product could be loaded into the carton 5 before or after closing either of the first end 68 and the second end 69 of the carton. It should be understood that either the first end 68 or the second end 69 can be assembled first, leaving the other end open so that the contents of the carton 5 may be introduced into the container. The open end can then be closed after the contents are loaded into the carton 5.

The assembled carton 5, with the handle 11 in the top wall 123, is shown FIGS. 2-5. As shown in FIGS. 2 and 4, the handle 11 extends into the closed ends 68, 69 at the top end flaps 49, 51, and the top end flap 49 is overlapped by the side end flaps 53, 61 and the top end flap 51 is overlapped by the side end flaps 55, 63. Alternatively, the handle 11 can be spaced apart from the first end and/or the second end of the carton. Alternative assembling, loading, and closing steps may be used without departing from the scope of this disclosure.

As shown in FIGS. 3-5, the handle 11 can be used to grasp the carton 5 by grasping the handle flaps 83, 85 at the respective access features 91 and folding the handle flaps 83, 85 upwardly and/or downwardly along the respective handle fold lines 87, 89 while pulling upwardly on the handle panel 81. Accordingly, the handle panel 81 can separated from the outer top panel 23 and/or the top end flaps 49, 51 along the cut lines 93 to an actuated position and a user can grasp the handle panel 81 and the handle flaps 83, 85 to carry the carton 5. When in the actuated position, the handle panel 81, the handle flaps 83, 85, and the access features 91 for an opening 126 in at least the outer top panel 23. The handle panel 81 and/or the reinforcing tape 95 can carry the force on the handle 11 front carrying the carton into the closed ends 68, 69 of the carton.

As shown in FIGS. 2-5, at least the inner top panel 41 and the top end flaps 65, 67 can form a handle closure 124. In the illustrated embodiment, the handle flaps 83, 85 and the handle panel 81 in the outer top panel 23 and the top end flaps 49, 51 overlap the handle closure 124, which can be in face-to-face contact with an interior surface of the outer top panel 23 and the top end flaps 49, 51 adjacent the cut lines 93 and the access features 91. Accordingly, the handle closure generally forms a seal or barrier between the interior of the carton 5 and the handle features in the outer top panel 23 and the top end flaps 49, 51 for helping to prevent the flowable material in the carton 5 from exiting the carton at the integrated handle 11 when the handle is in the flat position (e.g., FIG. 2) and/or the actuated position (FIGS. 3-5). For example, in one embodiment, the handle closure 124 extending in the inner top panel 41 and the top end flaps 65, 67 can remain closed under the outer top panel 23 and the top end flaps 49, 51 to help prevent product in the interior of the carton from exiting the carton through the opening 126 in the outer top and 23 formed by the handle panel 81 and the handle flaps 83, 85. It is understood that the carton 5 can have more than one handle or no handles or that the handle 11 can be otherwise shaped, arranged, and/or located without departing from the disclosure.

In the illustrated embodiment, the handle 11 is an integrated handle that does not necessarily require a separate handle assembly to be secured to the blank 3 during formation of the carton 5. The integrated handle 11 is formed from features formed in the blank 3 and, in one exemplary embodiment, the flat reinforcing tape 95 that is adhered to the blank. Accordingly, money and additional assembly requirements can be saved when the integrated handle replaces a separate handle that can be purchased separately from the carton blank and attached to a carton or carton blank for holding weighty flowable material.

The handle 11 can be otherwise shaped and located in the carton 5 without departing from the scope of this disclosure. For example, the handle panel 81 could extend in the side panel 25 or 37 and into the side end flaps 53, 55 or 61, 63. Alternatively, the handle 11 could extend longitudinally in the blank 3 in one or more of the top panels 23, 41, the side panels 25, 37, and the bottom panel 31. In an alternative embodiment, an optional second handle can be formed in the first end 68, the second end 69, and/or one or more of the panels 25, 31, 37, 41 from features that are substantially similar to the features that term the first handle 11. The second handle could also have different features than the first handle (e.g., the second handle could be a Wilton style handle or other style handles) without departing from the disclosure.

Figure 6:
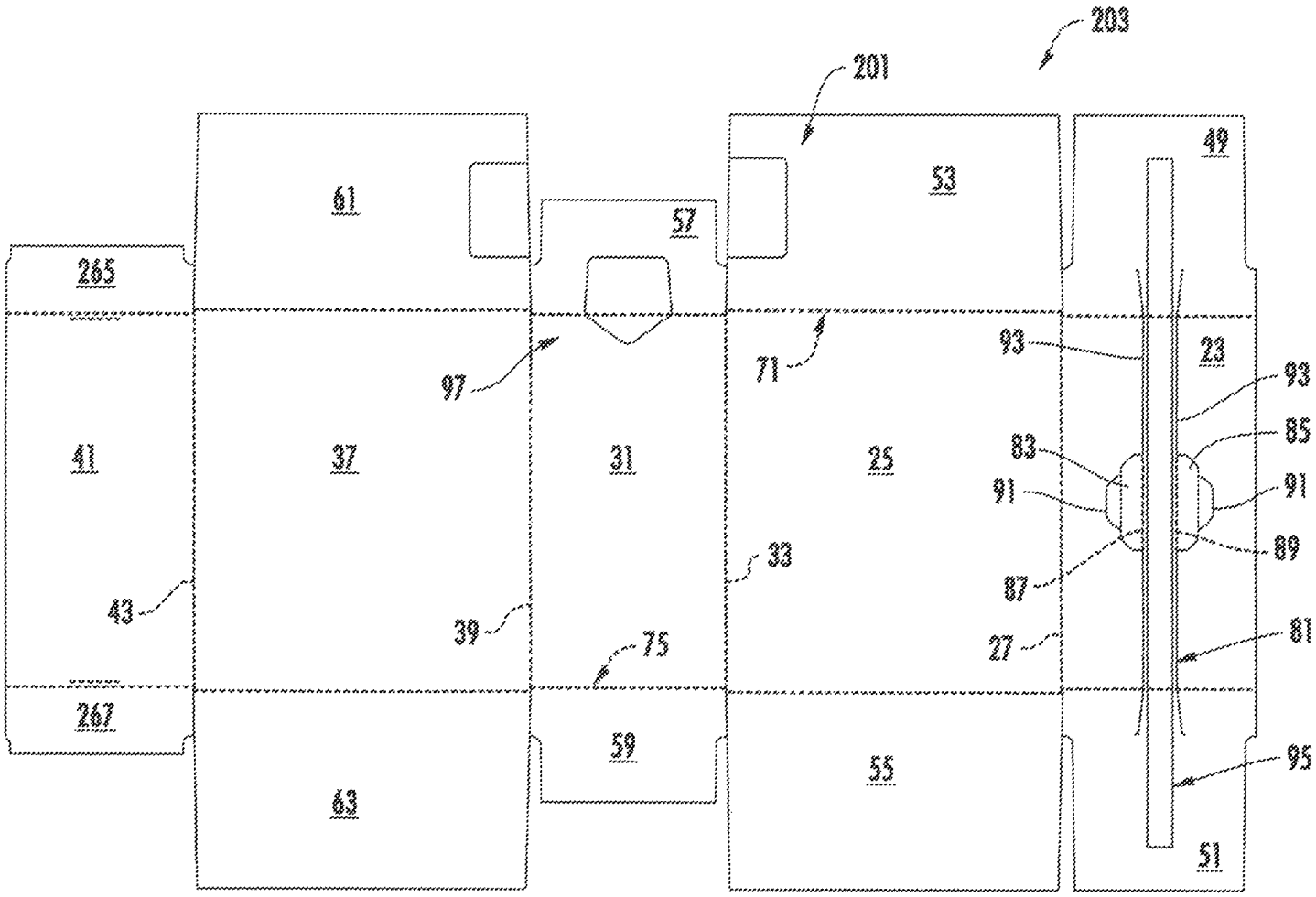
FIG. 6 is an interior plan view of a blank used to form a carton in accordance with a second exemplary embodiment of the disclosure.

FIG. 6 is a plan view of an exterior surface 201 of a carton blank 203 for forming a carton (not shown) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference number. As shown in FIG. 6, inner top end flaps 265, 267 are foldably connected to the inner top panel 41 along respective longitudinal told lines 71, 75. As shown in FIG. 6, the inner top end flaps 265, 267 are generally shorter in the lateral direction L2 than the inner top end flaps 65, 67 of the first embodiment (FIG. 1). The inner top end flaps 265, 267 and/or other features of the blank 203 could be otherwise shaped, arranged, positioned, and/or configured without departing from the disclosure.

Figure 7:
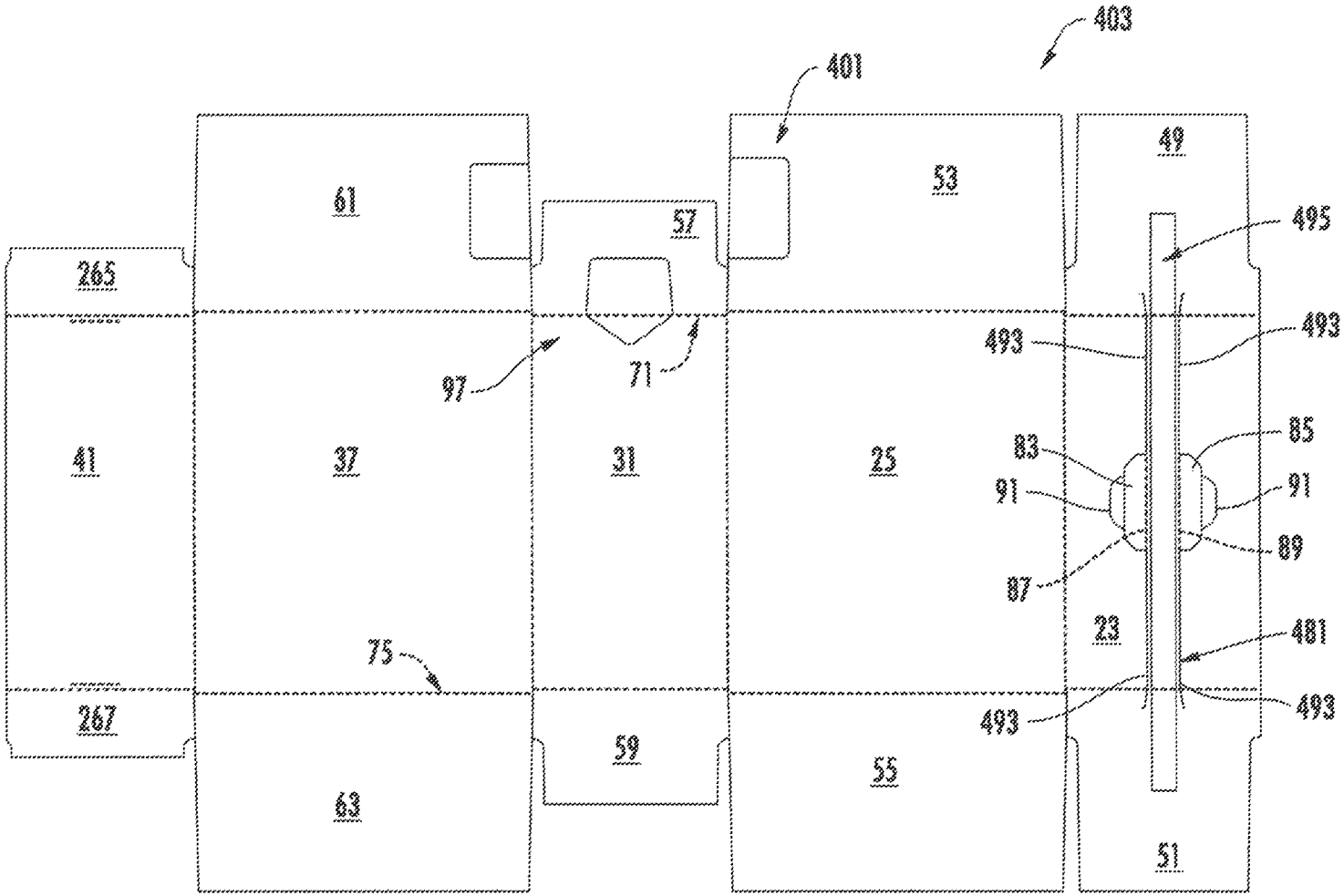
FIG. 7 is an interior plan view of a blank used to form a carton in accordance with a third exemplary embodiment of the disclosure.

FIG. 7 is a plan view of an exterior surface 401 of a carton blank 403 for forming a carton (not shown) according to a third embodiment of the disclosure. The third embodiment is generally similar to the second embodiment, except for variations noted and variations that will be apparent to one of ordinary skill in the art. Accordingly, similar or identical features of the embodiments have been given like or similar reference numbers. As shown in FIG. 7, the handle panel 481 and the eat or tear lines 493 extend only a short distance into the outer top end flaps 49, 51. Accordingly, the handle panel 481 and the reinforcing tape 495 are generally shorter than the handle panel 81 and the reinforcing tape 95 of the first embodiment (FIG. 1). The handle panel 481, the reinforcing tape 495, and/or the other handle features in the blank 403 could be otherwise shaped, arranged, positioned, and/or configured without departing from the disclosure.

Figure 8:
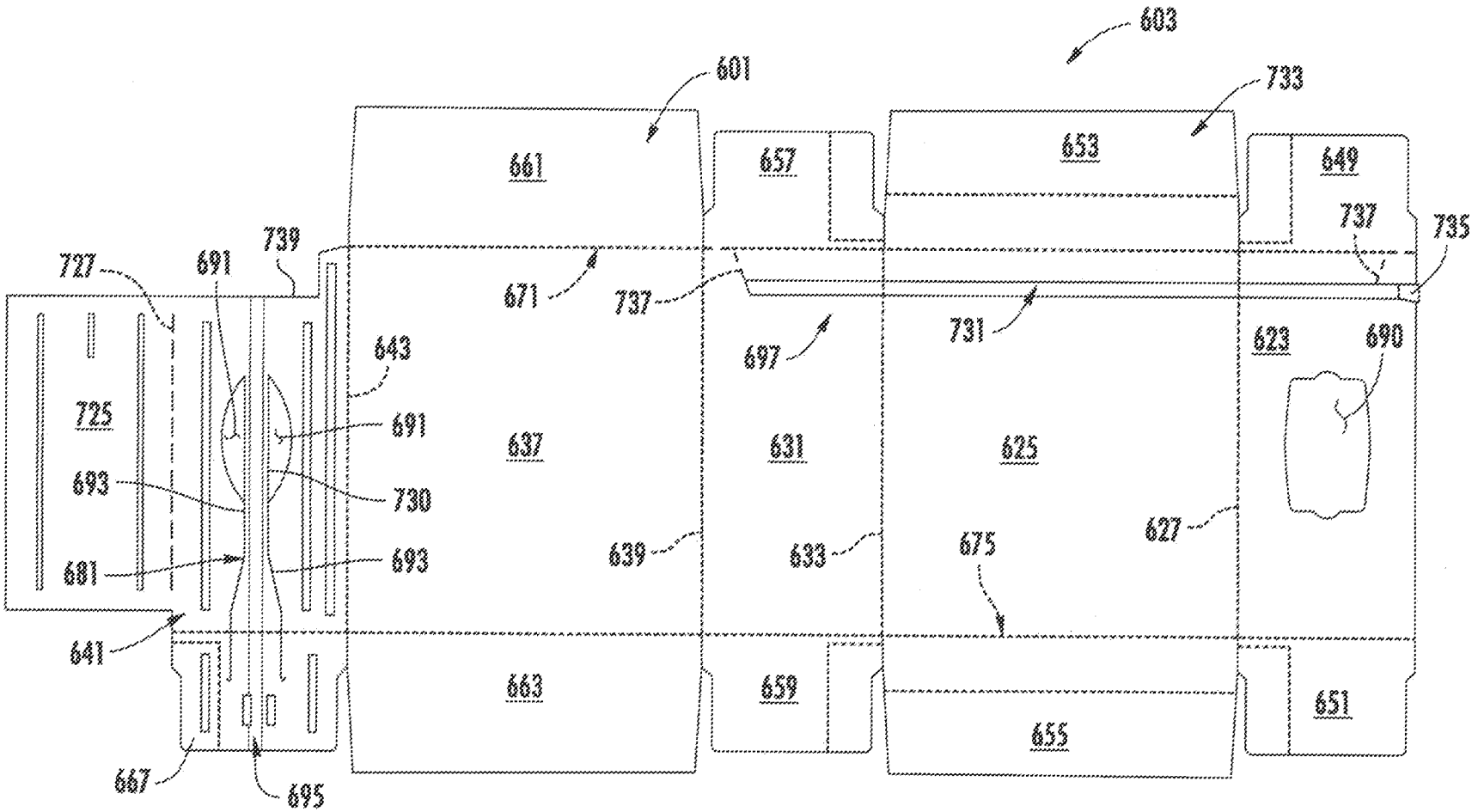
FIG. 8 is an interior plan view of a blank used to limn a carton in accordance with is fourth exemplary embodiment of the disclosure.

FIG. 8 is a plan view of an exterior surface 601 of a carton blank 603 for forming a carton 605 (FIGS. 9A and 9B) according to a fourth embodiment of the disclosure. The fourth embodiment is generally similar to the first embodiment, except for variations noted and variations that will be apparent to one of ordinary skill in the art. Accordingly, similar or identical features of the embodiments have been given like or similar reference numbers. As shown in FIG. 8, the inner top panel 641 is foldably connected to a reinforcement flap 725 along a lateral fold line 727. In one embodiment, the reinforcement flap 725 is folded and adhered in face-to-face contact with the interior surface of the inner top panel 64 and the inner top panel 641 is adhered in face-to-face contact with the outer top panel 623 such as by glue strips when the carton 605 is formed. In an alternative embodiment, the reinforcement flap 725 could be omitted.

Figure 9A:
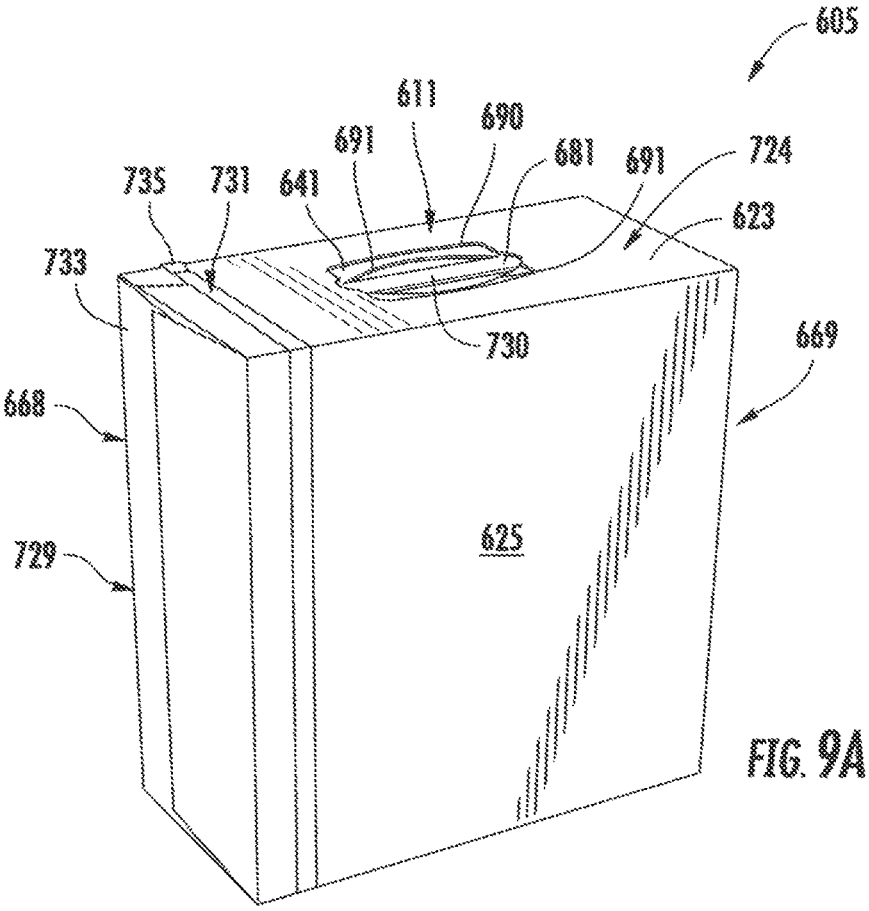
FIGS. 9A and 9B are isometric schematic views of the carton formed from the blank of FIG. 8.

The handle features in the fourth embodiment can include a handle opening 690 in the outer top panel 623 and the handle panel 681 extending in the inner to panel 641 and the inner top end flap 667. As shown in FIG. 8, an access opening 691 extends on either side of the handle panel 681, wherein the access openings 691 and the portion of the handle panel 681 extending between the access openings 691 (e.g., as grip portion 730) are aligned with the handle opening 690 in the outer top panel 623 when the carton 605 is erected (FIG. 9A). The handle opening 690 and/or the access openings 691 could be replaced by a tear-out panel or other features in an alternative embodiment. In the illustrated embodiment, the handle panel 681, defined by the cut or tear lines 693, extends from the access openings 691 and into the inner top end flap 667 so that the handle 611 firmed from the handle features in the blank 603 can help to carry the force from carrying the carton 605 at the handle to the closed end 669 of the carton. The reinforcing tape 695 can be adhered to the inner top panel 641 along the handle panel 681 in the lateral L2 direction to each of the longitudinally-extending edges of the inner top panel 641 and the inner top end flap 667, as shown in FIG. 8.

In one embodiment, portions of the reinforcement flap 725, the outer top panel 623, and the top end flap 651 cooperate to form the handle closure 724 in the carton 605. The reinforcement flap 725 is in face-to-face contact with the inner top panel 641 adjacent the access openings 691 and portions of the cut lines 693. The outer to panel 623 and the outer top end flap 651 are in face-to-face contact with the inner top panel 641 and the inner top end flap 667 adjacent the cut lines 693. Accordingly, the portion of the handle closure 724 in the reinforcement flap 725 generally forms a seal or barrier between the interior of the carton 5 and the other handle features, including the access openings 691 and the cut lines 693 in the inner top panel 641 and the handle opening 690 in the outer top panel 623. Additionally, the portion of the handle closure 724 in the outer top panel 623 and the outer to end flap 651 generally forms seal or barrier between the cut lines 691 in the inner top panel 641 and the inner top end flap 667 and the exterior of the carton 5.

Figure 10:
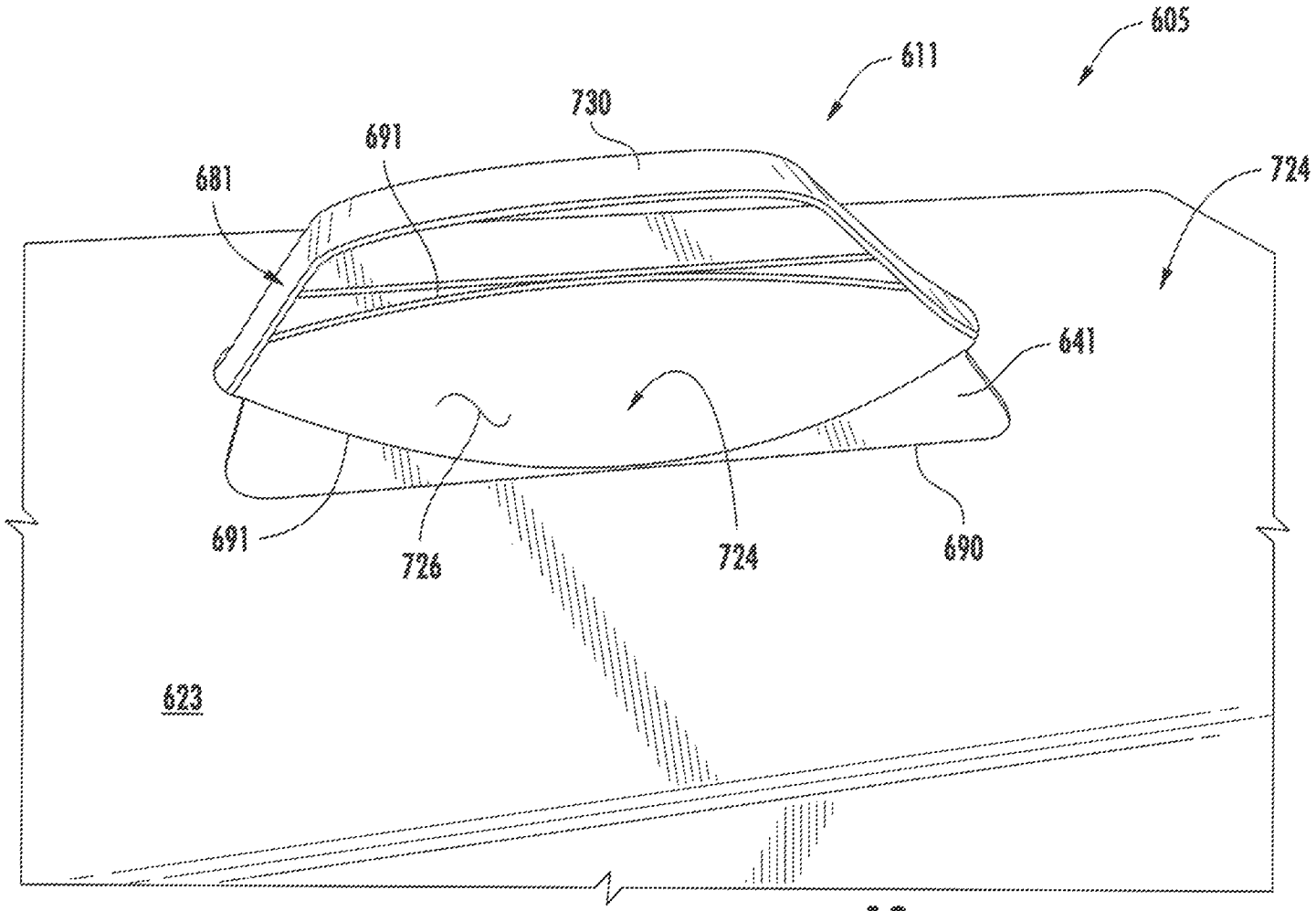
FIG. 10 is a perspective view of the carton of FIGS. 9A and 9B showing the activation of a handle in accordance with the fourth exemplary embodiment of the disclosure.

As shown in FIG. 10, the integrated handle 611 can be actuated by grasping the grip portion 730 of the handle panel 681 at the access openings 691 and pulling upwardly on the handle panel 681 to pull at least the grip portion 730 through the handle opening 690 in the outer top panel 623. The handle panel 681 can at least partially separate from the inner top panel 641 and the inner top end flap 667 along the cut lines 693 to form an opening 726 in at least the inner top panel 641. The portions of the handle closure 724 in the reinforcement panel 725, the outer top panel 623, and the outer top end flap 651 help maintain the barrier between the interior of the carton 5 and the exterior of the carton to help prevent flowable material from exiting the carton at the handle 611 whether the handle 611 is in the flap position (e.g. FIG. 9A) or the actuated position (e.g., FIG. 10). The handle features could be otherwise shaped, arranged, positioned, and/or configured without departing from the disclosure.

Figure 9B:
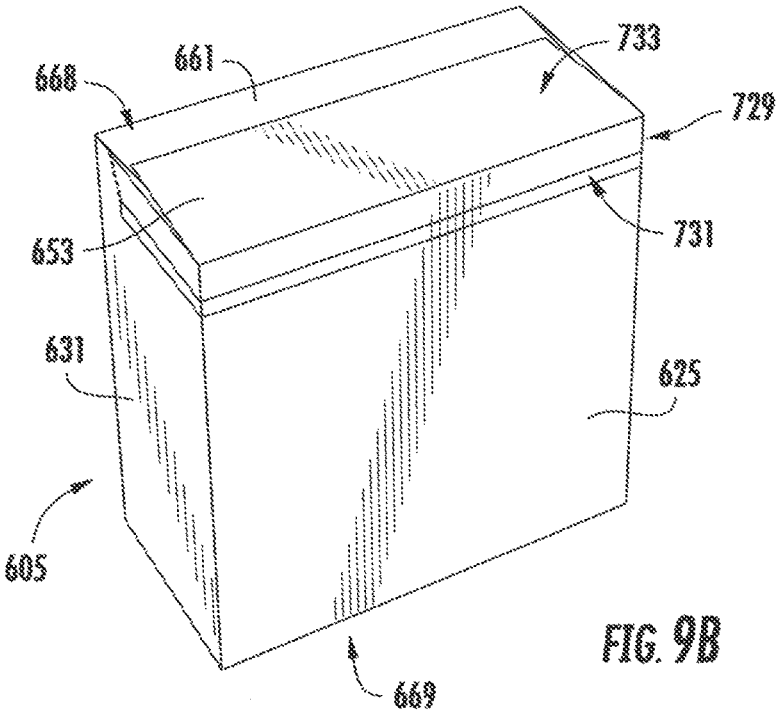

As shown in FIG. 8, the blank 603 includes dispenser features 697 for forming a dispenser 729 in the carton 605 (FIGS. 9A and 9B). The dispenser features 697 in the fourth embodiment can include a tear strip 731 and a dispenser panel 733 including the end flaps 649, 653, 657, 661 and portions of the panels 623, 625, 631. The tears strip 731 can include two spaced apart tear lines and a tab 735 for initiating tearing of the tear strip. The dispenser panel 733 can be defined by tear lines 737. In one embodiment, when the end flaps 649, 653, 657, 661 are overlapped and adhered to firm the first closed end 668 of the carton, the tear strip 731 can be removed and the dispenser panel can be pivoted upwardly along the portion of the longitudinal fold line 671 connecting the side end flap 661 to the side panel 637, tearing the tear lines 737. Accordingly, actuating the dispenser 729 can open the first end 668 of the carton 605. As shown in FIG. 8, the inner top panel 641 and the reinforcement flap 725 include a cutout 739 so that the inner to panel 641 and the reinforcement flap 725 are not overlapped by or adhered to the dispenser panel 733 when the carton 605 is formed from the blank 603. Accordingly, in one embodiment, the handle features do not interfere with the dispenser features 697. The dispenser features 697 and/or the dispenser 729 could be otherwise shaped, arranged, positioned, and configured without departing from the disclosure. In one embodiment, the carton 605 can include a liner and/or reinforcing insert attached to one or more of the panels and/or flaps of the blank 603.

Figure 11:
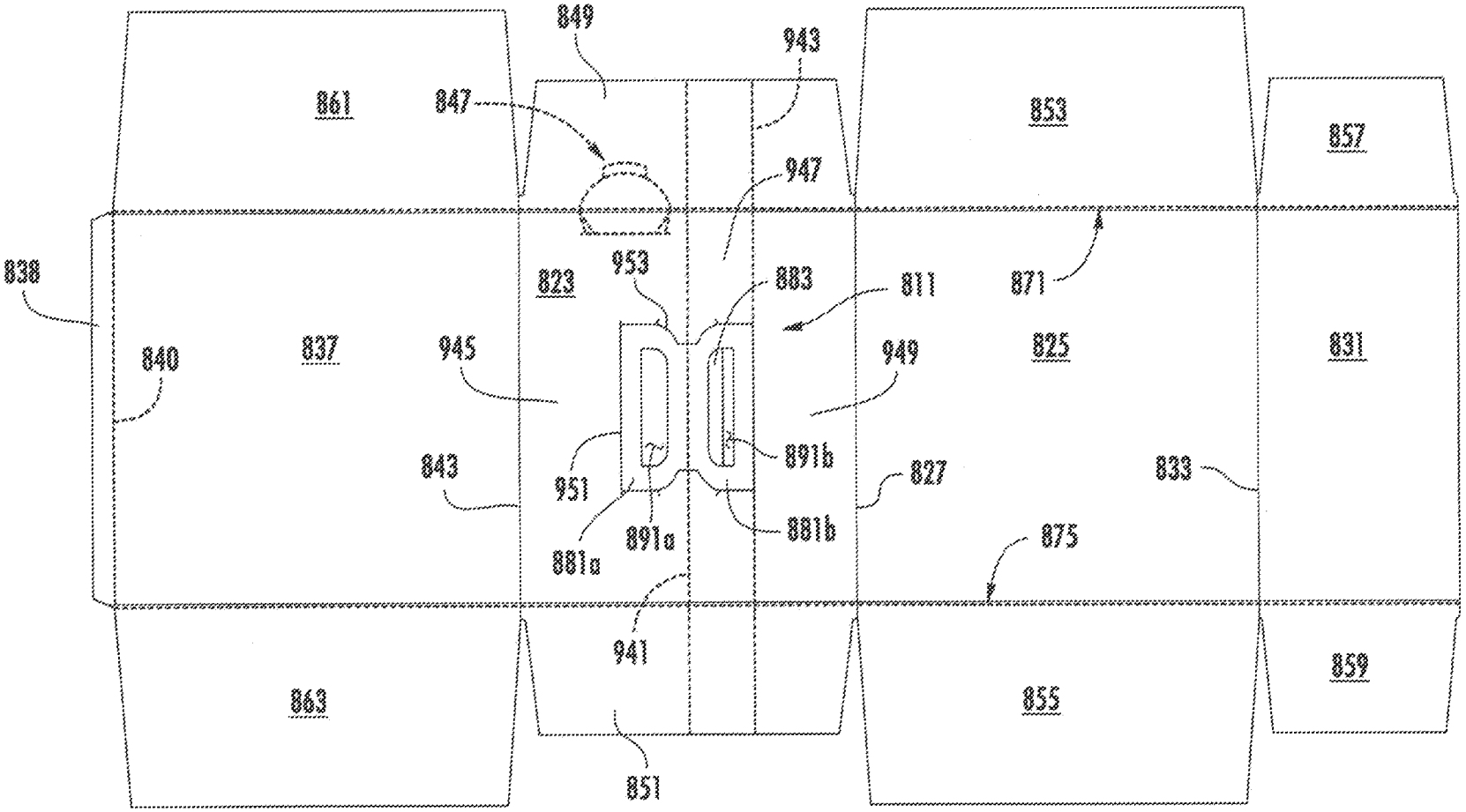
FIG. 11 is a plan view of a blank used to form a carton according to as fifth embodiment of the disclosure.

FIG. 11 is a plan view of a carton blank 803 for forming a carton (not show) according to a fifth embodiment of the disclosure. The fifth embodiment is generally similar to the first embodiment, except for variations noted and variations that will be apparent to one of ordinary skill in the art. Accordingly, similar or identical features of the embodiments have been given like or similar reference numbers. As shown in FIG. 11, the blank 803 includes a to panel 823 foldably connected to side panels 825, 837 along respective transverse fold lines 827, 843. A bottom panel 831 is file ally connected to the side panel 825 along a transverse fold line 833, and an attachment flap 838 is foldably connected to the side panel along a transverse fold 840. Top end flaps 849, 851 are foldably connected to the top panel 823, side end flaps 853, 855, 861, 863 are foldably connected the respective side panels 825, 837, and bottom end flaps 857, 859 are foldably connected to the bottom panel 831. The end flaps 849, 853, 861, 857 are foldably connected to the respective panels along a longitudinal fold line 871, and the end flaps 851, 855, 863, 859 are foldably connected to the respective panels along a longitudinal fold line 875.

As shown in FIG. 11, the blank 803 includes features for forming a handle 811 in the to panel 823 and the top end flaps 849, 851. In one embodiment, two spaced apart transverse fold lines 941, 943 extend in the top panel 823 and the top end flaps 849, 851 so that the top panel and the end flaps comprise an outer portion 945 fold ably connected to as central portion 947 along the transverse fold line 941 and an inner portion 949 foldably connected to the central portion 947 along the transverse fold line 943. The handle features 811 also include a first handle panel 881*a* foldably connected to the outer portion 945 of the top panel 823 along a transverse fold line 951 and a second handle panel 881*b* foldably connected to the inner portion 949 of the top panel 823 along the transverse fold line 943. The handle panels 881*a*, 881*b* are foldably connected to one another along the transverse fold line 941. The handle panels 881*a*, 881*b* are at least partially separable from the respective outer portion 945 and central portion 947 of the top and 823 along cut lines 953. Each of the handle panels 881*a*, 881*b* includes a respective handle opening 891*a*, 891*b*, and a handle flap 883 can be foldably connected to the second handle panel 881*b* adjacent the handle opening 891*b*. When the carton is formed, the top panel 823 and the top end flaps 849, 851 can be folded along the transverse fold lines 941, 943 so that the outer portion 945 overlaps the central portion 947 and the central portion 947 overlaps the inner portion 949. After folding along the fold lines 941, 943, the handle panels 881*a*, 881*b* are in face-to-face contact with the handle openings 891*a*, 891*b* generally aligned. The carton can be carried by grasping and pulling upwardly on the overlapped handle panels 881*a*, 881*b* to pivot the handle panels along the fold lines 951, 943 so that the handle panels at least partially extend upwardly from the top panel 823. The portion of the inner portion 949 that is overlapped by the outer portion 945 and the central portion 947 can at least partially form the handle closure (not shown) to help prevent flowable material from exiting the carton at the handle. The handle features could be otherwise shaped, arranged, positioned, and/or configured without departing from the disclosure.

As shown in FIG. 11, the blank 803 can include a dispenser feature 897. Alternatively, the dispenser feature could be otherwise located in the blank, the blank could include a different dispenser, or the dispenser could be omitted. The blank 803 could be otherwise shaped, arranged, positioned, and/or configured without departing from the disclosure.

Any of the features of the various embodiments of the disclosure can be combined with, replaced by, or otherwise configured with other features of other embodiments of the disclosure without departing from the scope of this disclosure. Further, it is noted that the handle features, dispenser features, and/or other features of the various embodiments can be incorporated into a carton having any carton style or panel configuration. The carton styles and panel configurations described above are included by way of example.

The blanks according to the present disclosure can be, for example, formed from coated paperboard and similar materials. For example, the interior and/or exterior sides of the blanks can be coated with a day coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in is tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a flowable material, the carton comprising:

a plurality of panels that extends around an interior of the carton to contain a flowable material therein, the plurality of panels comprising a first top panel, a second top panel, a first side panel, a second side panel, and a bottom panel, the first top panel at least partially overlaps the second top panel to form a top wall of the carton;

at least two end flaps respectively foldably attached to respective panels of the plurality of panels, wherein the at least two end flaps at least partially form an at least partially closed end of the carton, the at least two end flaps comprising a top end flap foldably connected to the first top panel; and an integrated handle comprising a handle panel extending in the first top panel and into the top end flap, a handle flap foldably connected to the handle panel, an access feature in the top panel and adjacent the handle flap, and a handle closure comprising at least a portion of the second top panel at least partially in face-to-face contact with at least the first top panel, the access feature comprises an access opening in the first top panel, wherein the handle panel, the handle flap, and the access opening overlap at least a portion of the handle closure, and the handle closure at least partially forms a seal or barrier in the top wall adjacent the handle panel for at least partially preventing flowable material from exiting the carton at the integrated handle when the handle panel is in a flat position or in an actuated position, in the actuated position, the handle flap is grasped through the access opening and folded upwardly relative to the handle panel when the handle is pulled upwardly to carry the carton.

2. The carton of claim 1, wherein the handle panel is at least partially separable from the first top panel and the top end flap along a cut line extending from the handle flap and into the top end flap.

3. The carton of claim 2, wherein the handle flap is foldably connected to the handle panel along a fold line, and the cut line extends from an end of the fold line.

4. The carton of claim 1, wherein the top end flap is a first top end flap, the at least two end flaps further comprise a second top end flap foldably connected to the second top panel, and the first top end flap at least partially overlaps the second top end flap.

5. The carton of claim 4, wherein the handle closure comprises at least a portion of the second top panel and the second top end flap adjacent the handle panel.

6. The carton of claim 5, wherein the handle panel is at least partially separable from the first top panel and the first top end flap along a cut line, and the second top panel and the second top end flap are at least partially in face-to-face contact with the respective first top panel and first top end flap adjacent the cut line.

7. The carton of claim 1, wherein at least a portion of the handle panel is separable from the top panel and the top end flap by two spaced apart cut lines extending in the first top panel and into the top end flap, and the handle closure is at least partially in face-to-face contact with the first top panel and the top end flap adjacent each of the cut lines.

8. The carton of claim 7, wherein each of the cut lines extends in a generally lateral direction in the first top panel, and at least a portion of each of the cut lines is oblique in the top end flap.

9. The carton of claim 7, wherein the handle flap is a first handle flap and an opposing second handle flap each foldably connected to the handle panel along a respective fold line, and each of the cut lines extends from a respective end of the respective fold lines.

10. The carton of claim 1, wherein the handle panel at least partially forms an opening in at least the first top panel when the handle panel is in the actuated position, and the handle closure at least partially forms the barrier between the opening in the first top panel and the interior of the carton.

11. The carton of claim 1, further comprising a reinforcement flap foldably connected to the first top panel, wherein the first top panel at least partially overlaps the reinforcement flap, and the handle closure comprises at least a portion of the reinforcement flap adjacent the handle panel.

12. The carton of claim 11, wherein the handle panel is at least partially separable from the first top panel and the top end flap along a cut line extending from the access opening, and the handle closure is at least partially in face-to-face contact with the first top panel adjacent the access opening and at least a portion of the cut line.

13. The carton of claim 11, wherein the first top panel is an outer top panel at least partially overlapping the second top panel, the integrated handle comprises a handle opening in the outer top panel, and the handle opening is aligned with at least a portion of the handle panel.

14. The carton of claim 13, wherein the handle closure further comprises at least a portion of the outer top panel adjacent a portion of the handle panel.

15. The carton of claim 13, wherein the at least two end flaps further comprise an outer top end flap at least partially overlapping the top end flap, and the handle closure further comprises at least a portion of the outer top panel and the outer top end flap adjacent the handle panel in the top panel and the top end flap.

16. The carton of claim 13, wherein the integrated handle further comprises a first access opening and an opposing second access opening extending in the top panel adjacent the handle panel, and the handle opening in the outer top panel is generally aligned with the first access opening and the second access opening.

17. The carton of claim 16, wherein the handle panel is at least partially separable from the top panel and the top end flap along two spaced apart cut lines extending from the respective access openings, the outer top panel is at least partially in face-to-face contact with an exterior surface of the top panel adjacent at least a portion of the cut lines, and the reinforcement panel is at least partially in face-to-face contact with an interior surface of the top panel adjacent the first access opening, the second access opening, and at least a portion of the cut lines.

18. The carton of claim 1, wherein the access opening is smaller than the handle flap.

19. The carton of claim 1, wherein the handle flap is formed from a portion of the handle panel.

20. The carton of claim 1, wherein plurality of panels fully encloses the interior of the carton.

21. A blank for forming a carton for containing a flowable material, the blank comprising:

a plurality of panels comprising a first top panel, a second top panel, a first side panel, a second side panel, and a bottom panel that are arranged to extend around an interior to contain a flowable material when the carton is formed from the blank, the first top panel being for at least partially overlapping the second top panel when the carton is formed from the blank;

at least two end flaps respectively foldably attached to respective panels of the plurality of panels, wherein the at least two end flaps are for at least partially forming an at least partially closed end of the carton formed from the blank, the at least two end flaps comprising a top end flap foldably connected to the first top panel; and handle features for forming an integrated handle comprising a handle panel extending in the first top panel and into the top end flap, a handle flap foldably connected to the handle panel, an access feature in the top panel and adjacent the handle flap, and a handle closure comprising at least a portion of the second top panel for being disposed at least partially in face-to-face contact with at least the first top panel when the carton is formed from the blank, the access feature comprises an access opening in the first top panel, wherein the handle panel, the handle flap, and the access opening are for overlapping at least a portion of the handle closure when the carton is formed from the blank, and the handle closure is for at least partially forming a seal or barrier adjacent the handle panel when the carton is formed from the blank for at least partially preventing flowable material from exiting the carton formed from the blank at the integrated handle, the handle flap is for being grasped through the access opening and being folded upwardly relative to the handle panel when the handle is pulled upwardly to carry the carton formed from the blank in an actuated position of the handle.

22. The blank of claim 21, wherein the handle panel is at least partially separable from the first top panel and the top end flap along a cut line extending from the handle flap and into the top end flap.

23. The blank of claim 22, wherein the handle flap is foldably connected to the handle panel along a fold line, and the cut line extends from an end of the fold line.

24. The blank of claim 21, wherein the top end flap is a first top end flap, the at least two end flaps further comprise a second top end flap foldably connected to the second top panel, and the first top end flap is for at least partially overlapping the second top end flap when the carton is formed from the blank.

25. The blank of claim 24, wherein the handle closure comprises at least a portion of the second top panel and the second top end flap adjacent the handle panel when the carton is formed from the blank.

26. The blank of claim 25, wherein the handle panel is at least partially separable from the first top panel and the first top end flap along a cut line.

27. The blank of claim 21, wherein at least a portion of the handle panel is separable from the first top panel and the top end flap by two spaced apart cut lines extending in the first top panel and into the top end flap, and the handle closure is for being at least partially in face-to-face contact with the first top panel and the top end flap adjacent each of the cut lines when the carton is formed from the blank.

28. The blank of claim 27, wherein each of the cut lines extends in a generally lateral direction in the first top panel, and at least a portion of each of the cut lines is oblique in the top end flap.

29. The blank of claim 27, wherein the handle flap is a first handle flap and an opposing second handle flap each foldably connected to the handle panel along a respective fold line, and each of the cut lines extends from a respective end of the respective fold lines.

30. The blank of claim 21, further comprising a reinforcement flap foldably connected to the first top panel, wherein the first top panel is for at least partially overlapping the reinforcement flap when the carton is formed from the blank, and the handle closure comprises at least a portion of the reinforcement flap adjacent the handle panel when the carton is formed from the blank.

31. The blank of claim 30, wherein the handle panel is at least partially separable from the first top panel and the top end flap along a cut line extending from the access opening.

32. The blank of claim 30, wherein the-first top panel is an outer top panel for at least partially overlapping the second top panel when the carton is formed from the blank, the handle features comprise a handle opening in the outer top panel, and the handle opening is for being aligned with at least a portion of the handle panel when the carton is formed from the blank.

33. The blank of claim 32, wherein the handle closure further comprises at least a portion of the outer top panel for being disposed adjacent a portion of the handle panel when the carton is formed from the blank.

34. The blank of claim 32, wherein the at least two end flaps further comprise an outer top end flap for at least partially overlapping the top end flap when the carton is formed from the blank, and the handle closure further comprises at least a portion of the outer top panel and the outer top end flap for being disposed adjacent the handle panel in the top panel and the top end flap when the carton is formed from the blank.

35. The blank of claim 32, wherein the handle features further comprise a first access opening and an opposing second access opening extending in the top panel adjacent the handle panel, and the handle opening in the outer top panel is for being generally aligned with the first access opening and the second access opening when the carton is formed from the blank.

36. The blank of claim 35, wherein the handle panel is at least partially separable from the top panel and the top end flap along two spaced apart cut lines extending from the respective access openings, the outer top panel is for being at least partially in face-to-face contact with an exterior surface of the top panel adjacent at least a portion of the cut lines when the carton is formed from the blank, and the reinforcement panel is for being at least partially in face-to-face contact with an interior surface of the top panel adjacent the first access opening, the second access opening, and at least a portion of the cut lines when the carton is formed from the blank.

37. The blank of claim 21, wherein the access opening is smaller than the handle flap.

38. The blank of claim 21, wherein the handle flap is formed from a portion of the handle panel.

39. The blank of claim 21, wherein the plurality of panels fully encloses the interior when the carton is formed from the blank.

40. A method for forming a carton for containing a flowable material, the method comprising:

obtaining a blank comprising a plurality of panels comprising a first top panel, a second top panel, a first side panel, a second side panel, and a bottom panel, at least two end flaps respectively foldably attached to respective panels of the plurality of panels, the at least two end flaps comprising a top end flap foldably connected to the first top panel, and handle features comprising a handle panel extending in the first top panel and into the top end flap, a handle flap foldably connected to the handle panel, an access feature in the top panel and adjacent the handle flap, and a handle closure comprising at least a portion of the second top panel, the access feature comprises an access opening in the first top panel;

forming an interior of the carton defined by the plurality of panels extending therearound to contain a flowable material therein, the forming the interior of the carton comprising positioning the first top panel to at least partially overlap the second top panel to form a top wall and forming an integrated handle from the handle features by positioning the handle closure at least partially in face-to-face contact with at least the first top panel so that the handle panel, the handle flap, and the access opening overlap at least a portion of the handle closure, wherein the handle closure at least partially forms a seal or barrier in the top wall adjacent the handle panel for at least partially preventing flowable material from exiting the carton at the integrated handle;

forming an at least partially closed end of the carton by at least partially overlapping the at least two end flaps; and positioning the handle to an actuated position by pulling the handle upwardly to carry the carton, in the actuated position, the handle flap is grasped through the access opening and folded upwardly relative to the handle panel.

41. The method of claim 40, wherein the top end flap is a first top end flap, the at least two end flaps further comprise a second top end flap foldably connected to the second top panel, the handle closure comprises at least a portion of the second top panel and the second top end flap adjacent the handle panel, and the positioning the handle closure comprises positioning the first top end flap to at least partially overlap the second top end flap.

42. The method of claim 40, wherein at least a portion of the handle panel is separable from the first top panel and the top end flap by two spaced apart cut lines extending in the first top panel and into the top end flap, and the positioning the handle closure comprises positioning at least a portion of the handle closure to be at least partially in face-to-face contact with the first top panel and the top end flap adjacent each of the cut lines.

43. The method of claim 40, wherein the blank further comprises a reinforcement flap foldably connected to the first top panel, the handle closure comprises at least a portion of the reinforcement flap, and the positioning the handle closure comprises positioning the first top panel to at least partially overlap the reinforcement flap so that at least a portion of the handle panel overlaps the handle closure.

44. The method of claim 43, wherein the first top panel is an outer top panel, the handle features further comprise a handle opening in the outer top panel, the handle closure further comprises at least a portion of the outer top panel, the forming the integrated handle comprising positioning the handle opening to be aligned with at least a portion of the handle panel, and the positioning the handle closure further comprises positioning the outer top panel to at least partially overlap the second top panel and the handle panel.

45. The method of claim 40, wherein the access opening is smaller than the handle flap.

46. The method of claim 40, wherein the handle flap is formed from a portion of the handle panel.

47. The method of claim 40, wherein the plurality of panels fully encloses the interior of the carton.

* * * * *